US011136889B2

(12) United States Patent
Garner et al.

(10) Patent No.: US 11,136,889 B2
(45) Date of Patent: Oct. 5, 2021

(54) COMPRESSOR BLADE HAVING ORGANIC VIBRATION STIFFENER

(71) Applicant: DOOSAN HEAVY INDUSTRIES & CONSTRUCTION CO., LTD., Changwon-si (KR)

(72) Inventors: Chad Garner, Jupiter, FL (US); Andres Jaramillo, Jupiter, FL (US)

( * ) Notice: Subject to any disclaimer, the term of this patent is extended or adjusted under 35 U.S.C. 154(b) by 109 days.

(21) Appl. No.: 16/503,572

(22) Filed: Jul. 4, 2019

(65) Prior Publication Data

US 2021/0003017 A1 Jan. 7, 2021

(51) Int. Cl.
*F01D 5/16* (2006.01)
*F01D 5/18* (2006.01)

(52) U.S. Cl.
CPC ..... *F01D 5/16* (2013.01); *F01D 5/18* (2013.01); *F05D 2260/15* (2013.01); *F05D 2260/96* (2013.01)

(58) Field of Classification Search
None
See application file for complete search history.

(56) References Cited

U.S. PATENT DOCUMENTS 5,295,789 A * 3/1994 Daguet ..... F01D 9/02 416/241 A
7,021,899 B2 * 4/2006 Ferte ..... F01D 5/18 416/229 A
8,241,004 B2 * 8/2012 Strother ..... F01D 5/16 416/232
8,381,398 B2 * 2/2013 Goldfinch ..... F04D 29/668 29/889.7
8,500,410 B2 * 8/2013 De Moura ..... F04D 29/668 416/229 R
9,903,434 B2 * 2/2018 Erno ..... F02C 3/04
2009/0057489 A1 * 3/2009 Goldfinch ..... F01D 5/147 244/123.14
2009/0304517 A1 * 12/2009 Strother ..... F01D 5/16 416/223 A
2010/0232974 A1 * 9/2010 De Moura ..... F01D 5/16 416/230
2015/0052898 A1 * 2/2015 Erno ..... F02C 3/04 60/726

FOREIGN PATENT DOCUMENTS

JP 2000-248901 A 9/2000
JP 2015-117626 A 6/2015

* cited by examiner

*Primary Examiner* — Ninh H. Nguyen
*Assistant Examiner* — Jason Fountain
(74) *Attorney, Agent, or Firm* — Harvest IP Law, LLP

(57) ABSTRACT

A compressor blade of a gas turbine includes a root member; an airfoil that is disposed on the root member and includes a first interior wall and a second interior wall forming a hollow space defined between the first and second interior walls; and an organic vibration stiffener (OVS) formed on at least one of the first interior wall and the second interior wall. The OVS is formed by 3D printing performed with respect to a surface of the at least one of the first interior wall and the second interior wall and includes an uneven surface formed on at least part of the at least one of the first interior wall and the second interior wall. The OVS may include a protruded or recessed portion protruding from or recessed into at least part of the at least one of the first interior wall and the second interior wall.

15 Claims, 8 Drawing Sheets

COMPRESSOR BLADE HAVING ORGANIC VIBRATION STIFFENER

BACKGROUND OF THE DISCLOSURE

Field of the Disclosure

Exemplary embodiments of the present disclosure relate to a compressor blade, and more particularly, to a hollow compressor blade in which an airfoil comprises an organic vibration stiffener (OVS) on an inner surface.

Description of the Related Art

Generally, gas turbines include a compressor, a combustor, and a turbine. The compressor draws external air, compresses the air, and then transmits it to the combustor. Air compressed by the compressor enters a high-pressure and high-temperature state. The combustor mixes fuel with compressed air supplied from the compressor, and combusts the mixture. Combustion gas generated by the combustion is discharged to the turbine. Turbine blades provided in the turbine are rotated by the combustion gas, whereby power is generated. Generated power may be used for generating electricity, driving a mechanical device, etc.

Part of the power generated by the turbine is fed back to drive a rotation of the compressor, which likewise has compressor blades (airfoils) arranged around an outer circumferential surface and provided in stages for drawing in and successively compressing the air. To achieve the desired operation of a gas turbine, an airfoil is manufactured to meet specific design requirements for every compressor blade, namely, aerodynamic performance. That is, an initial airfoil shape is determined by aerodynamics analysis. During operation, however, the compressor blades undergo stressing due to the forces of the driving rotation and air compression. The stressing can lead to compressor blade failure by attacking the integrity of the airfoil shape and structure.

Therefore, to prevent blade failure, the manufacturing process of a compressor airfoil includes an analyzing step to determine its mechanical vibrational response and then an adjustment step based on the analysis. If a natural frequency of the shape of an initially manufactured airfoil is near enough to an excitation frequency, the airfoil's shape should be altered to affect the natural frequency. According to the manufacturing process of an contemporary compressor blade, the shape alteration is performed with respect to the airfoil's external shape. However, the adjustment to an airfoil's external shape can be at the expense of aerodynamic performance.

Meanwhile, a contemporary compressor blade has a structure in which opposing airfoil panels form a hollow space between the panels, which may be formed of sheet metal, and a spar may be added by bonding to the panels to span the hollow space. Other known methods of manufacturing also involve bonded metal internal to a hollow blade to provide structural integrity. Such bonding techniques may include linear friction welding (LFW) or transient liquid phase bonding. In any event, the bonding is carried out in order to add a separate structural element, which complicates the process and can contribute to an unnecessarily heavy blade.

An improved hollow compressor blade and a hollow compressor blade manufacturing method of the same are needed by which the compressor blade may be harmonically tuned without affecting the external shape of the airfoil and without separately provided structural elements being installed using, for example, bonding techniques, inside the hollow.

SUMMARY OF THE DISCLOSURE

An object of the present disclosure is to provide a compressor blade having an organic vibration stiffener to allow the compressor blade to be tuned without having to compromise compressor aerodynamics.

Other objects and advantages of the present disclosure can be understood by the following description, and become apparent with reference to the embodiments of the present disclosure. Also, it will be clear to those skilled in the art to which the present disclosure pertains that the objects and advantages of the present disclosure can be realized by the means as claimed and combinations thereof.

In accordance with one aspect of the present disclosure, there is provided a compressor blade of a gas turbine. The compressor blade may include a root member; an airfoil that is disposed on the root member and includes a first interior wall and a second interior wall forming a hollow space defined between the first and second interior walls; and an organic vibration stiffener (OVS) formed on at least one of the first interior wall and the second interior wall.

The OVS may be formed by 3D printing performed with respect to a surface of the at least one of the first interior wall and the second interior wall.

The OVS may include an uneven surface formed on at least part of the at least one of the first interior wall and the second interior wall.

The OVS may include a protruded portion protruding from at least part of the at least one of the first interior wall and the second interior wall.

The OVS may include a recessed portion recessed into at least part of the at least one of the first interior wall and the second interior wall.

The OVS may be arranged according to an organic vibration stiffening process performed to locate points within the hollow space on the first interior wall and the second interior wall where the OVS is needed for shifting vibration frequencies of the compressor blade.

The OVS formed inside the hollow space may include an organic topology having an optimized thickness to create a predetermined shape on the corresponding one of the at least one of the first and second interior walls, the organic topology arranged according to the organic vibration stiffening process in correspondence to the located points within the hollow space.

The OVS formed inside the hollow space may include an OVS connection that includes one of a gusset and a webbing that connects the first and second interior walls to each other, the OVS connection arranged according to the organic vibration stiffening process in correspondence to the located points within the hollow space.

The OVS formed inside the hollow space may include a structural rib that adjusts the stiffness of the airfoil, the structural rib arranged according to the organic vibration stiffening process in correspondence to the located points within the hollow space.

The OVS formed inside the hollow space may include a printed patterning configured to control a weight of the airfoil according to a predetermined level and to maintain a balance of the airfoil, the printed patterning arranged according to the organic vibration stiffening process in correspondence to the located points within the hollow space.

The OVS formed inside the hollow space may include a damper formed on at least one of the first interior wall and the second interior wall, the damper arranged according to the organic vibration stiffening process in correspondence to the located points within the hollow space. During an untwist condition of the compressor blade, the damper of one interior wall may engage with a surface of the other interior wall to cause frictional contact between the first and second interior walls.

According to another aspect of the present disclosure, there is provided a compressor blade of a gas turbine, in which the compressor blade includes a root member; a first wall that is disposed on the root member and extends from a leading edge of the compressor blade to a trailing edge of the compressor blade; and a second wall that is disposed on the root member and extends from the leading edge of the compressor blade to the trailing edge of the compressor blade. Here, the first wall and the second wall may define a hollow space by bonding to each other at the leading edge and the trailing edge, and at least one of the first wall and the second wall May include an organic vibration stiffener (OVS) formed on at least part of an inner surface of the at least one of the first wall and the second wall.

According to another aspect of the present disclosure, a gas turbine may include a compressor to compress air introduced from an outside, the compressor including a compressor blade; a combustor to produce combustion gas by combusting a mixture of fuel and the compressed air; and a turbine to produce power using the combustion gas. Here, the compressor blade may be consistent with the above-described compressor blade.

The advantageous feature of the present invention is that the compressor blade comprises an organic vibration stiffening (OVS) feature inside the hollow of the compressor blade, thereby shifting vibration frequency without degrading aerodynamic performance of the compressor blade. The OVS features can be manufactured using 3D printing techniques to change the thickness of the wall (e.g., grooves and/or protrusions) or to build a structural rib or pattern on the interior wall.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF THE EMBODIMENTS

Figure 1:
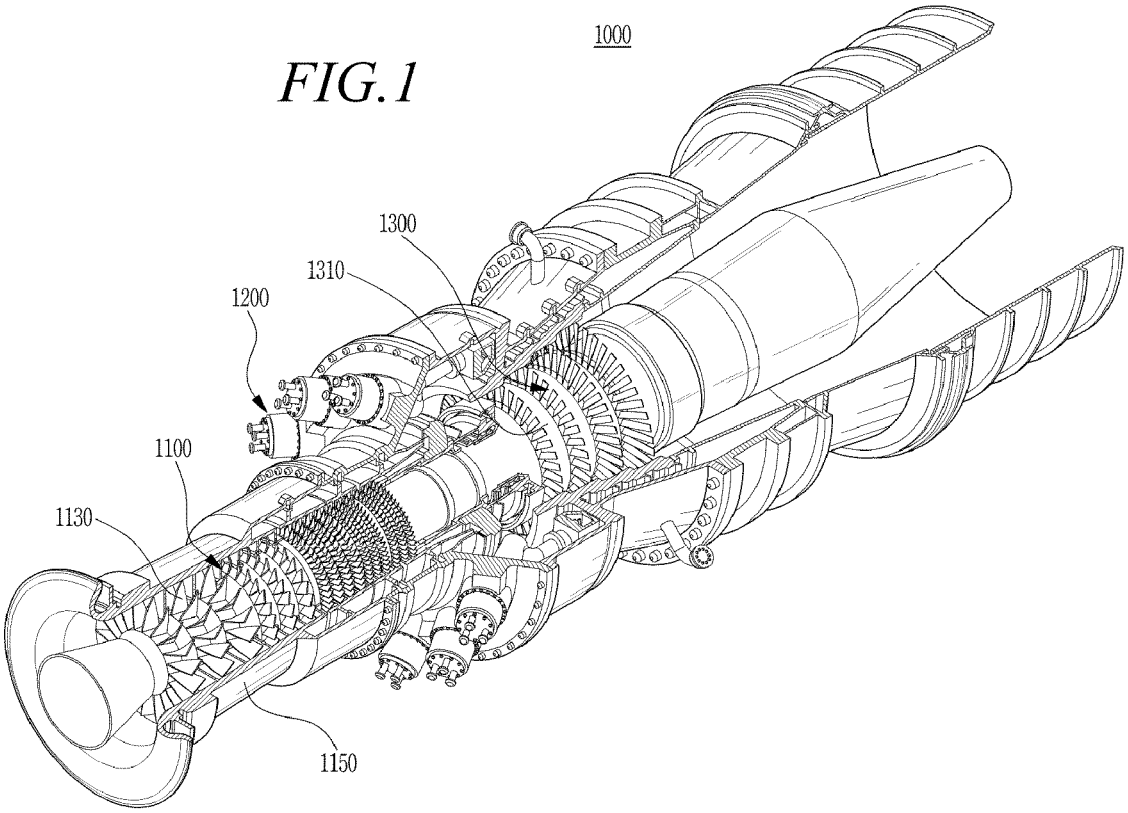
FIG. 1 is a cutaway perspective view of a gas turbine in which may be applied a compressor blade in accordance with the present disclosure.

Since the present disclosure may be modified in various forms, and may have various embodiments, preferred embodiments will be illustrated in the accompanying drawings and described in detail with reference to the drawings. However, this is not intended to limit the present disclosure to particular modes of practice, and it is to be appreciated that all changes, equivalents, and substitutes that do not depart from the spirit and technical scope of the present disclosure are encompassed in the present disclosure.

The terminology used herein is for the purpose of describing particular embodiments only and is not intended to be limiting. In the present disclosure, the singular forms are intended to include the plural forms as well, unless the context clearly indicates otherwise. It will be further understood that the terms "comprise," "include," "have," etc. when used in this specification, specify the presence of stated features, integers, steps, operations, elements, components, and/or combinations of them but do not preclude the presence or addition of one or more other features, integers, steps, operations, elements, components, and/or combinations.

Hereinafter, preferred embodiments of the present disclosure will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, in the accompanying drawings, some elements may be exaggerated, omitted, or depicted schematically.

Figure 2:
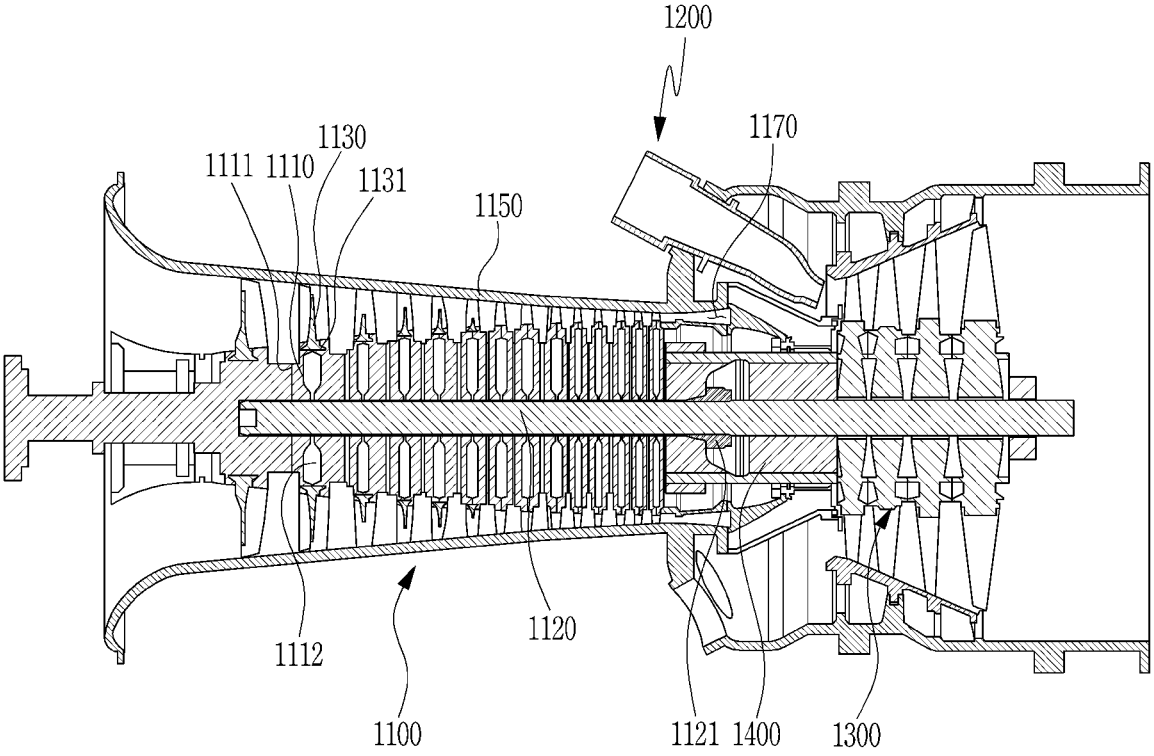
FIG. 2 is a cross section of the gas turbine of FIG. 1.
Figure 3:
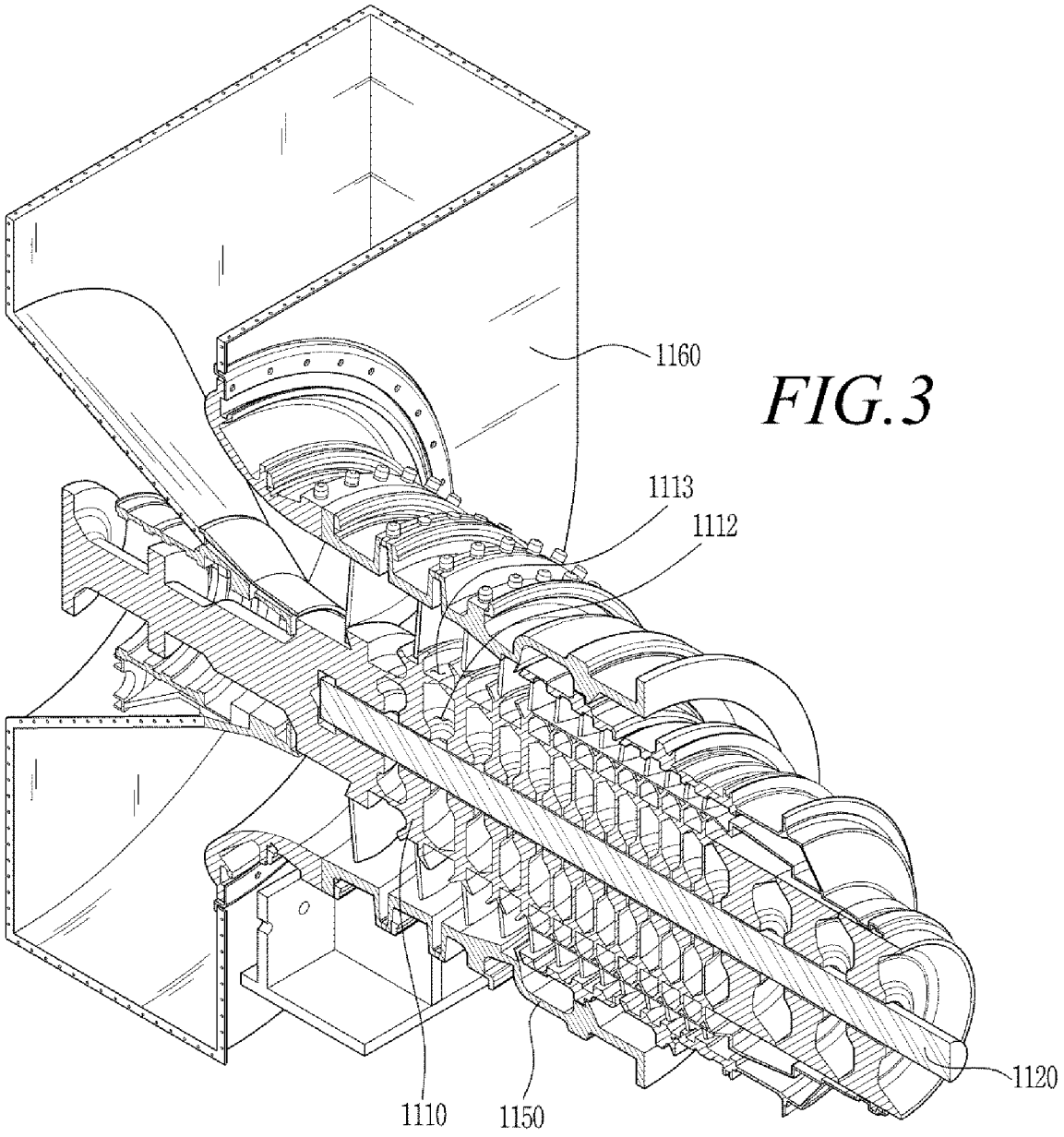
FIG. 3 is a cutaway perspective view of the compressor of the gas turbine of FIG. 1.

FIGS. 1 and 2 illustrate an internal structure of a gas turbine 1000 in accordance with an embodiment of the present disclosure, and FIG. 3 shows the compressor 1100 of the gas turbine.

As illustrated in FIGS. 1 to 3, the gas turbine 1000 may include a compressor 1100, a combustor 120, and a turbine 1300. The compressor 1100 may draw external air, and compress the air. The combustor 1200 may mix fuel with the air compressed by the compressor 1100, and combust the mixture. The turbine 1300 includes a plurality of turbine blades 1310, which are installed so as to be rotatable by combustion gas discharged from the combustor 1200. Hereinafter, the compressor 1100, which is a critical part of the present disclosure, will be described in detail, and detailed descriptions of the combustor 1200 and the turbine 1300 will be omitted.

The compressor 1100 among critical components of the gas turbine 1000 includes a plurality of rotor disks 1110, a center tie rod 1120, a plurality of blades 1130, a compressor casing 1150, an intake 1160, and a diffuser 1170.

The blades 1130 are mounted to each of the rotor disks 1110. The center tie rod 1120 is provided to pass through the rotor disk 1110. Each rotor disk 1110 may be rotated by rotation of the center tie rod 1120, thus rotating the blades 1130. The rotor disks 1110 may comprise fourteen such rotor disks arranged in a multistage structure.

The plurality of rotor disks 1110 are coupled by the center tie rod 1120 such that the rotor disks 1110 are not spaced apart from each other in an axial direction. The respective rotor disks 1110 through which the center tie rod 1120 passes are arranged along the axial direction. A plurality of protrusions (not illustrated) may be provided on an outer circumferential portion of each of the rotor disks 1110, and a flange 1111 may be provided on the outer circumferential portion so that the flange 1111 can be coupled with an adjacent rotor disk 1110 to allow the rotor disks 1110 to rotate together.

An air flow passage 1112 may be formed in any one or more of the plurality of rotor disks 1110. Air compressed by the blade 1130 of the compressor 1100 may move to the turbine 1300 through the air flow passage 1112, thus cooling the turbine blade 1310.

The center tie rod 1120 is disposed to pass through the rotor disks 1110 to align the rotor disks 1110. The center tie rod 1120 may receive torque generated from the turbine 1300 and rotate the rotor disk 1110. To this end, a torque tube 1400 functioning as a torque transmission member to transmit rotating torque generated from the turbine 1300 to the compressor 1100 may be disposed between the compressor 1100 and the turbine 1300.

One end of the center tie rod 1120 is coupled to the farthest upstream rotor disk, and the other end is inserted into and coupled to the torque tube 1400 using a compression nut 1121. The compression nut 1121 compresses the torque tube 1400 toward the rotor disks 1110 so that the respective rotor disks 1110 tightly contact each other.

The plurality of blades 1130 are radially coupled to an outer circumferential surface of each of the rotor disks 1110. Each blade 1130 may include a root member 1131 through which the blade 1130 is coupled to the rotor disk 1110. The rotor disk 1110 may include a slot 1113 into which the root member 1131 is inserted. In the present embodiment, the blades 1130 are coupled to the rotor disks 1110 in a slot manner, but the present disclosure is not limited to this coupling method. That is, various methods may be used to couple the blade 1130 and the rotor disk 1110.

The blades 1130 are rotated by the rotation of the rotor disk 1110 to compress drawn air and to move the compressed air to a subsequent stage. Air is compressed gradually to higher and higher pressures while passing through the blades 1130 successively forming the multi-stage structure.

The compressor casing 1150 forms the outer appearance of the compressor 1100 and houses the rotor disks 1110, the center tie rod 1120, the blades 1130, and so forth. The compressor casing 1150 may have a connection tube through which air compressed in a multi-stage manner by the multi-stage compressor blades 1130 flows to the turbine 1300 to cool the turbine blades.

The intake 1160 is disposed at an inlet of the compressor 1100. The intake 1160 draws external air into the compressor 1100. The diffuser 1170 for diffusing and moving compressed air is disposed on an outlet of the compressor 1100. The diffuser 1170 may rectify air compressed by the compressor 1100 before the compressed air is supplied to the combustor 1200, and may convert a portion of kinetic energy of the compressed air into static pressure energy. The compressed air that has passed through the diffuser 1170 is drawn into the combustor 1200.

FIGS. 4A-4E respectively illustrate embodiments of a compressor blade 1130 according to the present disclosure. The compressor blade 1130 of the present disclosure may include a root member 1131 and a compressor blade airfoil 1132 disposed on the root member 1131. The airfoil 1132 includes opposing panels forming a hollow space 1133 defined between inner surfaces of the opposing panels. The opposing panels may be respectively formed by a first interior wall 1132*a* having an inner surface and a second interior wall 1132*b* having an inner surface facing the inner surface of the first interior wall 1132*a*.

According to the present disclosure, at least one of the first interior wall 1132*a* and the second interior wall 1132*b* comprises an uneven surface or OVS feature 1135. The uneven surface of the first and second interior walls 1132*a* and 1132*b* is preferably formed through an additive manufacturing (AM) process, which includes any of 3D printing, rapid prototyping (RP), direct digital manufacturing (DDM), layered manufacturing, and additive fabrication, and most preferably, the AM process includes 3D printing.

The OVS feature 1135 is a feature added for the sole purpose of affecting vibration frequency. The OVS feature 1135 may have a structure in which the thickness of at least one of the first and second interior walls 1132*a* and 1132*b* is varied to create an arrangement of grooves (recesses), protrusions, or both that are formed over at least part of at least one of the first and second interior walls 1132*a* and 1132*b*. In addition, or alternatively, the structure of the OVS feature 1135 according to the present disclosure may include one or both of a structural rib or pattern that is built upon one or both of the first and second interior walls 1132*a* and 1132*b*, to protrude into the interior of the hollow space 1133.

In any event, the OVS feature 1135 is arranged according to an organic vibration stiffening process performed to locate points within the hollow space 1133 on the first interior wall 1132*a* and the second interior wall 1132*b* where the OVS feature 1135 is needed for shifting vibration frequencies of the compressor blade 1130.

The compressor blade 1130 may be configured to include the root member 1131 and the first and second walls 1132*a* and 1132*b*, wherein at least one of the first wall and the second wall includes an organic vibration stiffener (OVS) feature 1135 formed on at least part of an inner surface of the at least one of the first wall and the second wall. In this configuration, the first wall 1132*a* is disposed on the root member 1131 and extends from a leading edge of the compressor blade 1130 to a trailing edge of the compressor blade 1130, and the second wall 132*b* is disposed on the root member 1131 and extends from the leading edge of the compressor blade 1130 to the trailing edge of the compressor blade 1130, such that the first wall and the second wall define the hollow space 1133 by bonding to each other at the leading edge and the trailing edge.

Figure 4A:
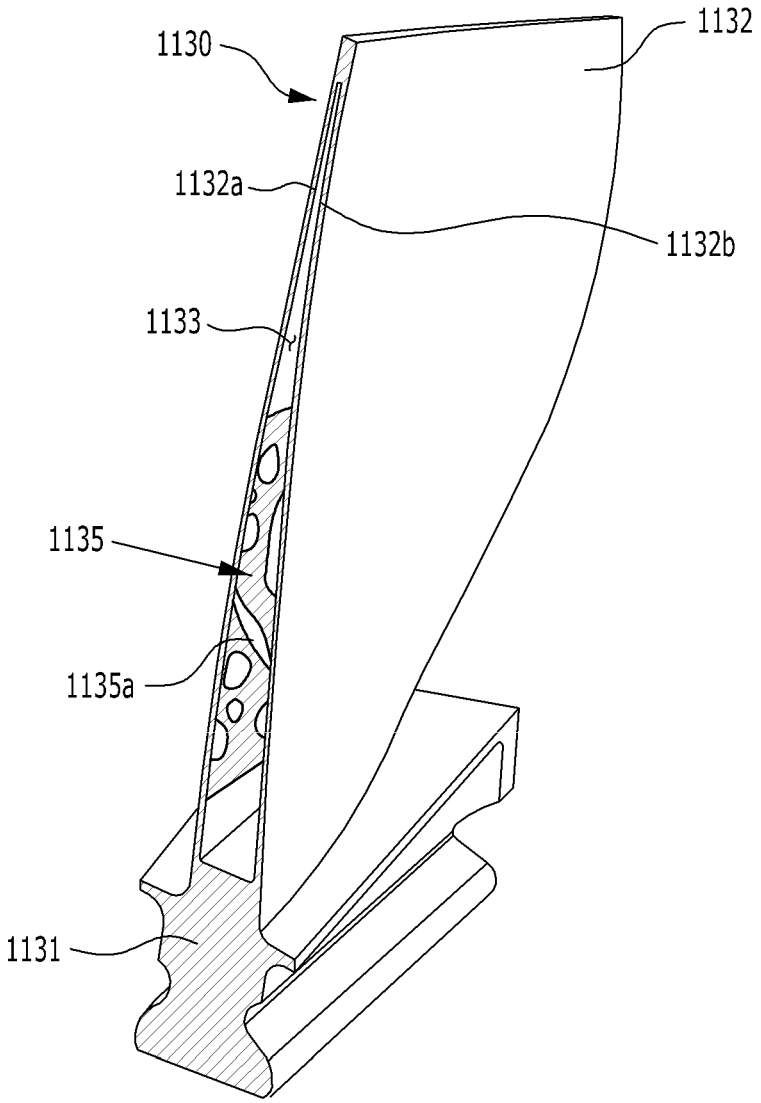
FIG. 4A is a perspective view of a compressor blade according to an embodiment of the present disclosure in which an OVS feature formed inside a hollow includes an organic topology.

Referring to FIG. 4A, the compressor blade 1130 of the present invention in which the OVS feature 1135 is formed inside the hollow space 1133 comprises an organic topology 1135*a* having an optimized thickness to create a desired shape on the corresponding interior wall. The organic topology 1135*a* is arranged according to the organic vibration stiffening process in correspondence to the located points within the hollow space 1133 on the first interior wall 1132*a* and the second interior wall 1132*b* where the OVS feature 1135 is needed for shifting vibration frequencies of the compressor blade 1130. The organic topology 1135*a* is preferably formed by 3D printing.

Figure 4B:
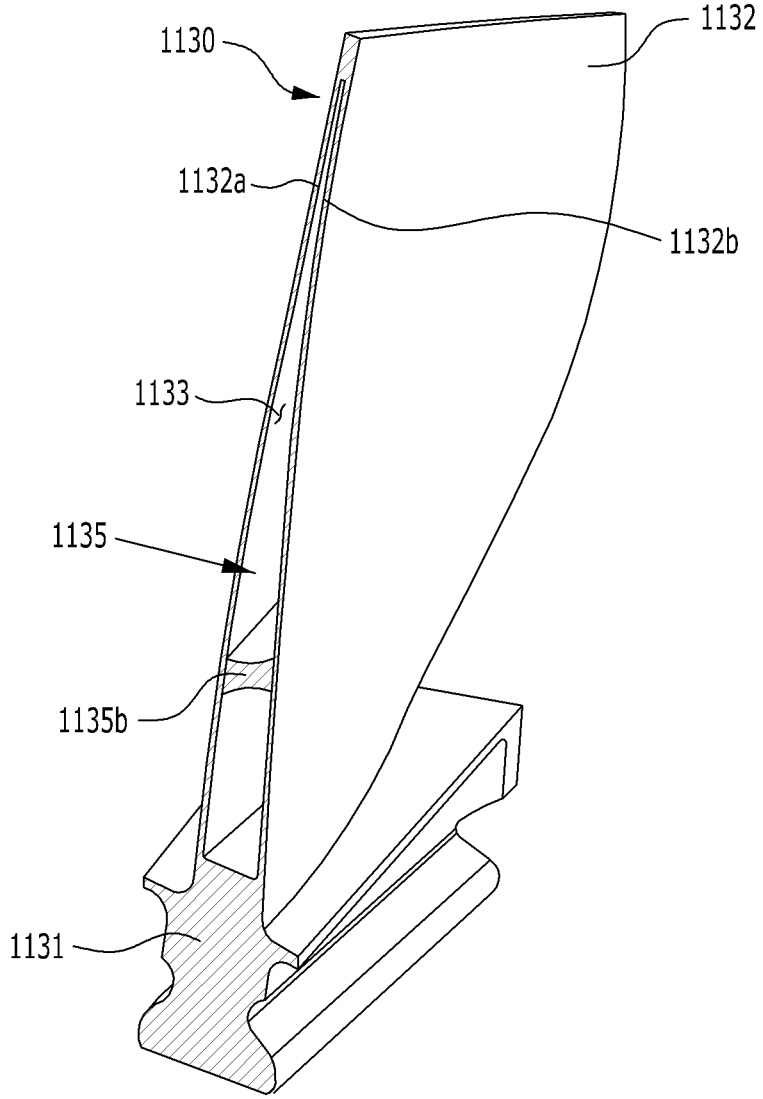
FIG. 4B is a perspective view of a compressor blade according to an embodiment of the present disclosure in which an OVS feature formed inside a hollow includes an OVS connection.

Referring to FIG. 4B, the compressor blade 1130 of the present invention in which the OVS feature 1135 is formed inside the hollow space 1133 comprises an OVS connection 1135*b* that includes one of a gusset or webbing that connects one of the first and second interior walls 1132*a* and 1132*b* to the other. The OVS connection 1135*b* is arranged according to the organic vibration stiffening process in correspondence to the located points within the hollow space 1133 on the first interior wall 1132*a* and the second interior wall 1132*b* where the OVS feature 1135 is needed for shifting vibration frequencies of the compressor blade 1130. The OVS connection 1135*b* is preferably formed by 3D printing.

Figure 4C:
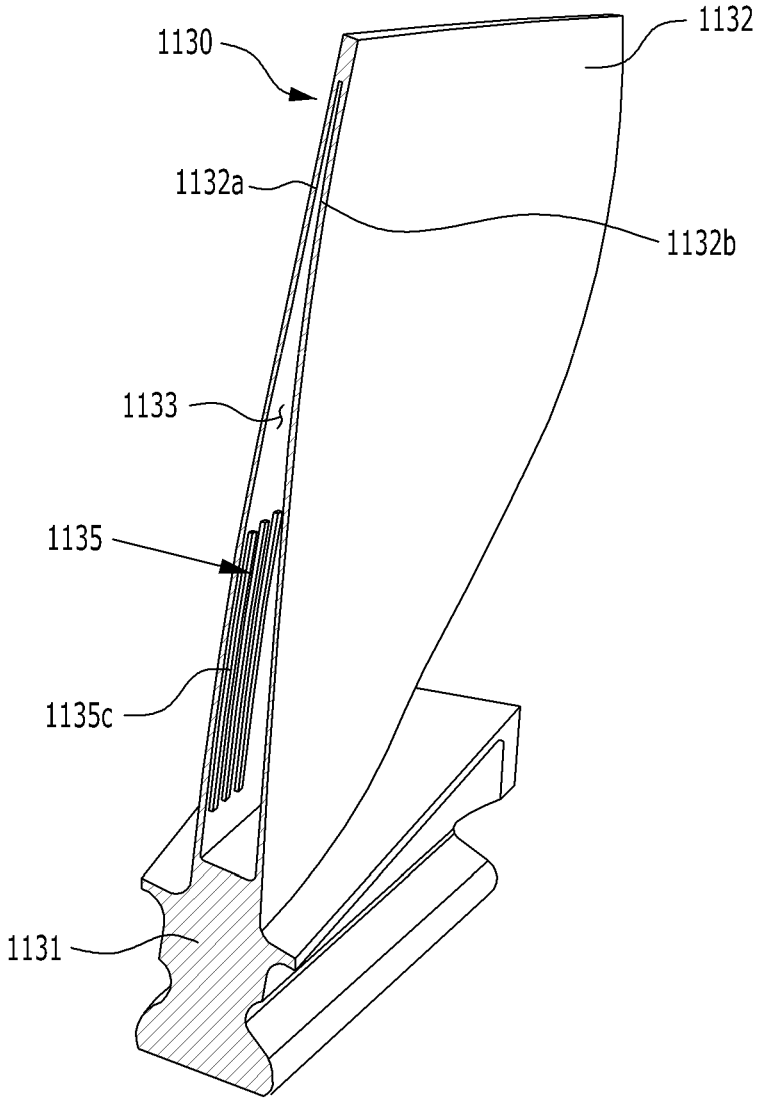
FIG. 4C is a perspective view of a compressor blade according to an embodiment of the present disclosure in which an OVS feature formed inside a hollow includes a structural rib.

Referring to FIG. 4C, the compressor blade 1130 of the present invention in which the OVS feature 1135 is formed inside the hollow space 1133 comprises a structural rib 1135*c* that adjusts the stiffness of the airfoil 1132. The structural rib 1135*c* is arranged according to the organic vibration stiffening process in correspondence to the located points within the hollow space 1133 on the first interior wall 1132*a* and the second interior wall 1132*b* where the OVS feature 1135 is needed for shifting vibration frequencies of the compressor blade 1130. The structural rib 1135*c* is preferably formed by 3D printing.

Figure 4D:
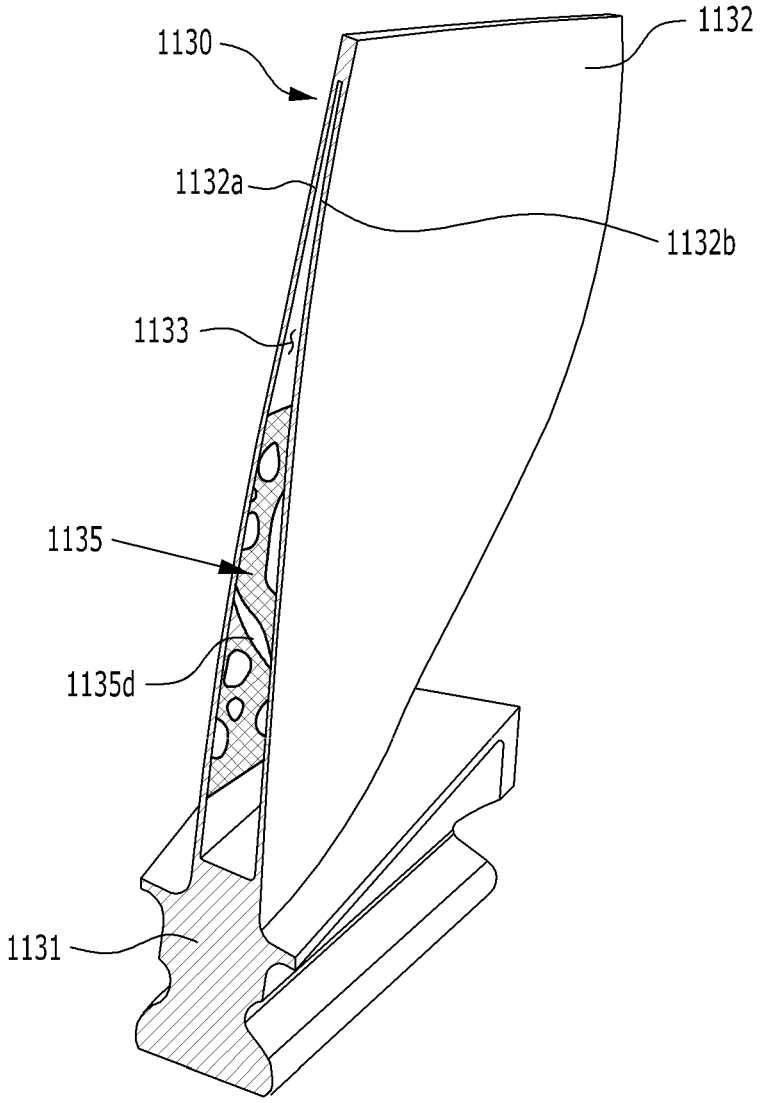
FIG. 4D is a perspective view of a compressor blade according to an embodiment of the present disclosure in which an OVS feature formed inside a hollow includes a printed patterning.

Referring to FIG. 4D, the compressor blade 1130 of the present invention in which the OVS feature 1135 is formed inside the hollow space 1133 comprises a printed patterning 1135*d* to control the weight of the airfoil 1132 according to desired levels and to maintain the balance of the airfoil 1132. The printed patterning 1135*d* is arranged according to the organic vibration stiffening process in correspondence to the located points within the hollow space 1133 on the first interior wall 1132*a* and the second interior wall 1132*b* where the OVS feature 1135 is needed for shifting vibration frequencies of the compressor blade 1130. The printed patterning 1135*d* is preferably formed by 3D printing.

Figure 4E:
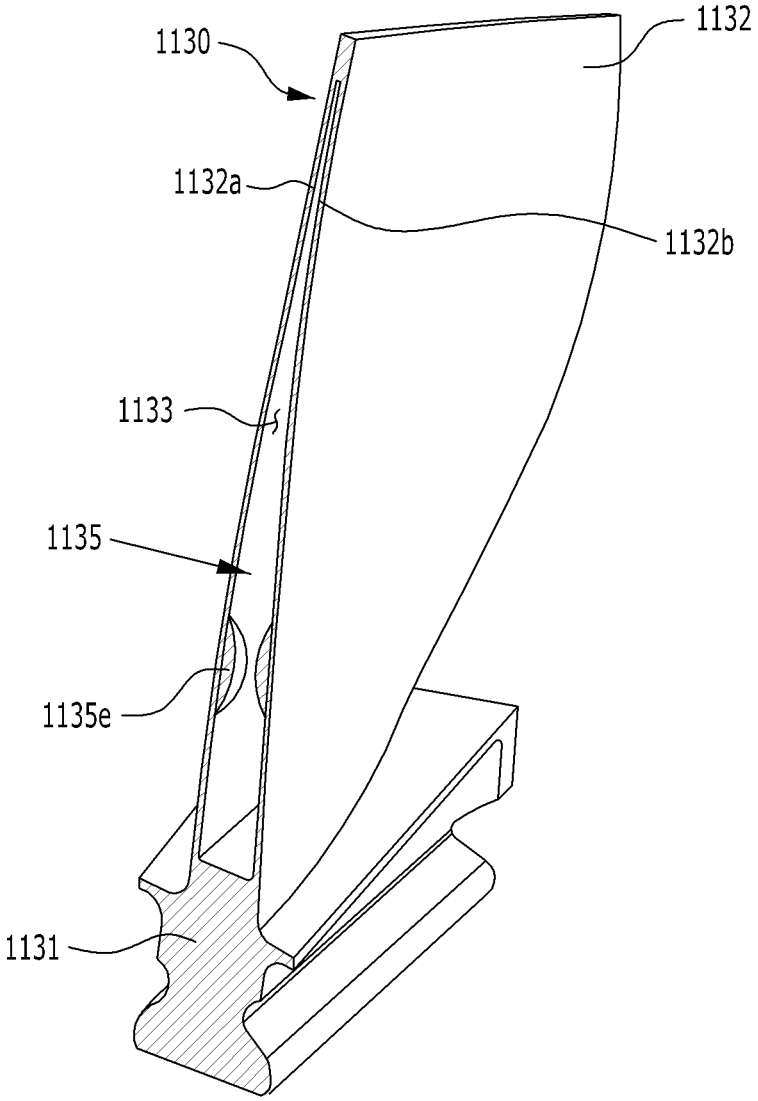
FIG. 4E is a perspective view of a compressor blade according to an embodiment of the present disclosure in which an OVS feature formed inside a hollow includes a damping feature.

Referring to FIG. 4E, the compressor blade 1130 of the present invention in which the OVS feature 1135 is formed inside the hollow space 1133 comprises a damping feature 1135*e* formed on one or both of the first interior wall 1132*a* and the second interior wall 1132*b* such that, during a blade untwist condition, the damping feature 1135*e* of one interior wall engages with the other interior wall or with the damping feature 1135*e* formed on the other interior wall to cause frictional contact between the interior walls. The damping feature 1135*e* is arranged according to the organic vibration stiffening process in correspondence to the located points within the hollow space 1133 on the first interior wall 1132*a* and the second interior wall 1132*b* where the OVS feature 1135 is needed for shifting vibration frequencies of the compressor blade 1130. The damping feature 1135*e* is preferably formed by 3D printing.

It should be appreciated that the compressor blade 1130 of the present invention may include an OVS feature 1135 according to any one of or any combination of the above embodiments of FIGS. 4A to 4E.

The present disclosure utilizes OVS technology in connection with an analysis to determine the mechanical vibrational response of a manufactured airfoil, before performing an airfoil shape adjustment step based on the analysis. The OVS technology locates stiffness and/or mass inside the hollow compressor blade in order to apply the OVS feature only where it is needed for shifting the airfoil's vibration frequencies. The OVS features are internal features of the hollow blade, which are formed by 3D printing with respect to a surface of at least one of the first interior wall and the second interior wall.

According to the present disclosure, a compressor blade can be harmonically tuned without affecting the external shape of the airfoil, through the adding of any of the above described OVS features to the inside of a hollow blade by way of additive manufacturing (AM) technology including 3D printing.

The hollow compressor blades of the present disclosure can be manufactured without using conventional bonding methods for providing structural integrity.

Accordingly, the compressor blade of the present disclosure, which comprises an organic vibration stiffening (OVS) feature inside the hollow of the compressor blade, enables the shifting of a vibration frequency without degrading aerodynamic performance of the compressor blade.

While the present disclosure has been described with respect to the specific embodiments, it will be apparent to those skilled in the art that various changes and modifications may be made without departing from the scope of the disclosure as defined in the following claims.

What is claimed is:

1. A compressor blade of a gas turbine, comprising:

a root member;

an airfoil that is disposed on the root member and includes a first interior wall and a second interior wall forming a hollow space defined between the first and second interior walls; and an organic vibration stiffener (OVS) formed on at least one of the first interior wall and the second interior wall, wherein the OVS includes an uneven surface of a structure in which a thickness of the at least one of the first interior wall and the second interior wall is varied, and wherein the uneven surface of the OVS is formed by 3D printing performed with respect to a surface of the at least one of the first interior wall and the second interior wall, while the surfaces of the first interior wall and the second interior wall are even.

2. The compressor blade according to claim 1, wherein the uneven surface is formed on at least part of the at least one of the first interior wall and the second interior wall.

3. The compressor blade according to claim 1, wherein the OVS includes a protruded portion protruding from at least part of the at least one of the first interior wall and the second interior wall.

4. The compressor blade according to claim 1, wherein the OVS includes a recessed portion recessed into at least part of the at least one of the first interior wall and the second interior wall.

5. The compressor blade according to claim 1, wherein the OVS is arranged according to an organic vibration stiffening process performed to locate points within the hollow space on the first interior wall and the second interior wall where the OVS is needed for shifting vibration frequencies of the compressor blade.

6. The compressor blade according to claim 5, wherein the OVS formed inside the hollow space comprises an organic topology having an optimized thickness to create a predetermined shape on the corresponding one of the at least one of the first and second interior walls, the organic topology arranged according to the organic vibration stiffening process in correspondence to the located points within the hollow space, and wherein the predetermined shape includes a protruded portion protruding from at least part of the at least one of the first interior wall and the second interior wall and a recessed portion recessed into at least part of the at least one of the first interior wall and the second interior wall.

7. The compressor blade according to claim 5, wherein the OVS formed inside the hollow space comprises an OVS connection that includes one of a gusset and a webbing that connects the first and second interior walls to each other, the OVS connection arranged according to the organic vibration stiffening process in correspondence to the located points within the hollow space.

8. The compressor blade according to claim 5, wherein the OVS formed inside the hollow space comprises a structural rib that adjusts the stiffness of the airfoil, the structural rib arranged according to the organic vibration stiffening process in correspondence to the located points within the hollow space, and wherein the structural rib includes a plurality of ribs formed on one of the first and second interior walls, each of the plurality of ribs extending in a radial direction of the airfoil.

9. The compressor blade according to claim 5, wherein the OVS formed inside the hollow space comprises a printed patterning arranged according to the organic vibration stiffening process in correspondence to the located points within the hollow space, and wherein the printed patterning is disposed on the at least one of the first interior wall and the second interior wall such that a weight of the airfoil is controlled according to a predetermined level and such that a balance of the airfoil is maintained.

10. The compressor blade according to claim 5, wherein the OVS formed inside the hollow space comprises a damper formed on each of the first interior wall and the second interior wall, the damper arranged according to the organic vibration stiffening process in correspondence to the located points within the hollow space, and wherein, during an untwist condition of the compressor blade, the damper of one interior wall engages with the other interior wall via the damper of the other interior wall to cause frictional contact between the first and second interior walls.

11. A compressor blade of a gas turbine, comprising:

a root member;

a first wall that is disposed on the root member and extends from a leading edge of the compressor blade to a trailing edge of the compressor blade; and a second wall that is disposed on the root member and extends from the leading edge of the compressor blade to the trailing edge of the compressor blade, wherein the first wall and the second wall define a hollow space by bonding to each other at the leading edge and the trailing edge, wherein at least one of the first wall and the second wall includes an organic vibration stiffener (OVS) formed on at least part of an inner surface of the at least one of the first wall and the second wall, wherein the OVS includes an uneven surface of a structure in which a thickness of the at least one of the first wall and the second wall is varied, and wherein the uneven surface of the OVS is formed by 3D printing performed with respect to a surface of the at least one of the first wall and the second wall, while the surfaces of the first interior wall and the second interior wall are even.

12. The compressor blade according to claim 11, wherein the uneven surface is formed on at least part of the at least one of the first interior wall and the second interior wall.

13. The compressor blade according to claim 11, wherein the OVS includes a protruded portion protruding from at least part of the at least one of the first interior wall and the second interior wall.

14. The compressor blade according to claim 11, wherein the OVS includes a recessed portion recessed into at least part of the at least one of the first interior wall and the second interior wall.

15. A gas turbine comprising a compressor to compress air introduced from an outside, the compressor including a compressor blade; a combustor to produce combustion gas by combusting a mixture of fuel and the compressed air; and a turbine to produce power using the combustion gas, wherein the compressor blade comprises:

a root member;

an airfoil that is disposed on the root member and includes a first interior wall and a second interior wall forming a hollow space defined between the first and second interior walls; and an organic vibration stiffener (OVS) formed on at least one of the first interior wall and the second interior wall, wherein the OVS includes an uneven surface of a structure in which a thickness of the at least one of the first interior wall and the second interior wall is varied, and wherein the uneven surface of the OVS is formed by 3D printing performed with respect to a surface of the at least one of the first interior wall and the second interior wall, while the surfaces of the first interior wall and the second interior wall are even.

* * * * *